US007162755B2

(12) United States Patent
Mintz et al.

(10) Patent No.: US 7,162,755 B2
(45) Date of Patent: Jan. 16, 2007

(54) PLUMBING FIXTURE WITH MOUNTING APPARATUS

(76) Inventors: Daniel Mintz, 13 Catherine St., #13 C, Nyack, NY (US) 10960; Syed Ispahani, P.O. Box 248, Saddle River, NJ (US) 07458

( * ) Notice: Subject to any disclaimer, the term of this patent is extended or adjusted under 35 U.S.C. 154(b) by 274 days.

(21) Appl. No.: 10/844,190

(22) Filed: May 12, 2004

(65) Prior Publication Data

US 2005/0251907 A1 Nov. 17, 2005

(51) Int. Cl.
*E03C 1/042* (2006.01)

(52) U.S. Cl. ..... 4/695

(58) Field of Classification Search ..... 4/675–677, 4/695; 137/359, 801
See application file for complete search history.

(56) References Cited

U.S. PATENT DOCUMENTS 5,518,016 A * 5/1996 Sharwark ..... 137/15.01
6,161,230 A * 12/2000 Pitsch ..... 4/678
7,003,818 B1 * 2/2006 McNerney et al. ..... 4/695

* cited by examiner

*Primary Examiner*—Charles E. Phillips
(74) *Attorney, Agent, or Firm*—Notaro & Michalos PC

(57) ABSTRACT

A plumbing fixture has a mounting assembly for removably mounting the plumbing fixture to a sink deck with a sink hole. The plumbing fixture has a housing, a water outlet, a tubing assembly fluidly connected to the water outlet, and a cavity. The mounting assembly comprises a mounting member having a bore. The mounting member is positioned between the housing and the sink and is adapted to be received in the cavity of the housing. A means removably attaches the housing to the mounting member. At least one hollow member connects to the mounting member. The hollow member extends from the slot in the mounting member and passes through the sink hole. The hollow member is adapted to receive the tubing assembly. A means secures the hollow member to the sink.

20 Claims, 5 Drawing Sheets

PLUMBING FIXTURE WITH MOUNTING APPARATUS

FIELD AND BACKGROUND OF THE INVENTION

The present invention relates to plumbing fixtures and in particular to a plumbing fixture which may be installed or removed from above the sink deck.

Plumbing fixtures include kitchen and bathroom faucets, soap dispensers, side sprayers, shower fixtures and other liquid spray devices customarily mounted on a sink deck.

In the traditional method for installing plumbing fixtures on sink decks, a substantial portion of the labor must be done in the area beneath the sink deck, which is usually small and cramped. In particular, a faucet is customarily mounted on a sink deck at the rear of a basin by fasteners installed from beneath the deck. Water tubing connects to the faucet inlets at the sink deck and to hot and cold water inlet fittings below the sink deck.

Although plumbing fixtures which are removed from the top side of the sink deck are known, they are unduly complex, expensive, difficult to install and service, and inconvenient to use. Moreover, they still often require some access to the fixture from below the sink to connect the plumbing fixture hose to a water inlet pipe and/or to collect pieces of the faucet which fall off upon its removal.

U.S. Pat. No. 4,356,574 to Johnson discloses a faucet assembly which uses a u-shaped tie bar beneath the sink deck to secure the faucet assembly to the sink. Screws connect the faucet base above the sink deck to the u-shaped tie bar below the sink deck. To remove the faucet, the screws are unscrewed to detach the faucet base from the u-shaped tie bar. The u-shaped bar drops off when the screws are removed.

U.S. Pat. No. 6,220,278 to Sauter et al. discloses a faucet assembly which uses toggle bolts to secure the faucet to the sink. The toggle bolts are received in two holes in the faucet base and corresponding holes in the sink. The wings of the toggle bolts engage the underside of the sink. To remove the faucet assembly from the sink, the toggle bolts are rotated until the wings drop off.

A need still exists for a less complicated faucet structure which can be removed from the top of the sink deck without any drop-off parts.

SUMMARY OF THE INVENTION

It is an object of the present invention to provide a plumbing fixture with a mounting device that removably mounts the plumbing fixture on the sink deck and allows the fixture to be removed from the top side of the deck while the mounting device remains attached to the sink deck.

Another object of the present invention is to provide a device for mounting a plumbing fixture on a sink deck in which the work for installing and/or removing the plumbing fixture is performed from above the sink deck.

Yet another object of the present invention is to provide a device for mounting a plumbing fixture on a sink deck which is adapted to mount different style plumbing fixtures to the sink deck.

In accordance with the present invention, a plumbing fixture has a device for removably mounting the fixture to a sink deck. The plumbing fixture includes a housing, one or more control handles, a valve assembly, a water tubing assembly for receiving water from a water supply line and transferring water from the valve assembly through a water outlet or water spout, as well as, other conventional fixture parts. The mounting device is positioned below the plumbing fixture and above the sink deck. The plumbing fixture has a female member with an internal cavity which receives the mounting device. Fasteners removably connect the plumbing fixture to the mounting device.

The mounting device has at least one bore in alignment with a sink hole on the sink deck. At least one hollow member is fixed to the mounting device in alignment with the bore. The hollow member extends from the bore and passes through the sink hole. A locking device engages the hollow member to secure the mounting device to the sink deck.

The hollow member is adapted, i.e., sized, shaped and positioned relative to the faucet housing, to receive the water tubing assembly. Water tubing passes through the hollow member and connects to water supply lines located beneath the sink deck.

The invention allows the plumbing fixture to be readily removed from above the sink deck. To replace or remove the plumbing fixture, the fasteners are removed to disengage the plumbing fixture from the mounting device. The plumbing fixture is then lifted off the mounting device. The water tubing, along with the water supply lines, pass upward through the bore of the mounting device and the sink holes. The water tubing is disconnected from the water supply lines to completely detach the plumbing fixture from the sink. The mounting device remains attached to the sink deck.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENTS

The plumbing fixture of the present invention can be any plumbing fixture customarily affixed to the top side of a sink deck or to a wall, i.e., faucets, water control knobs, water sprays, etc. The embodiments of the invention shown in FIGS. 1–5 illustrate a faucet assembly 200 and a mounting assembly 100.

Figure 1:
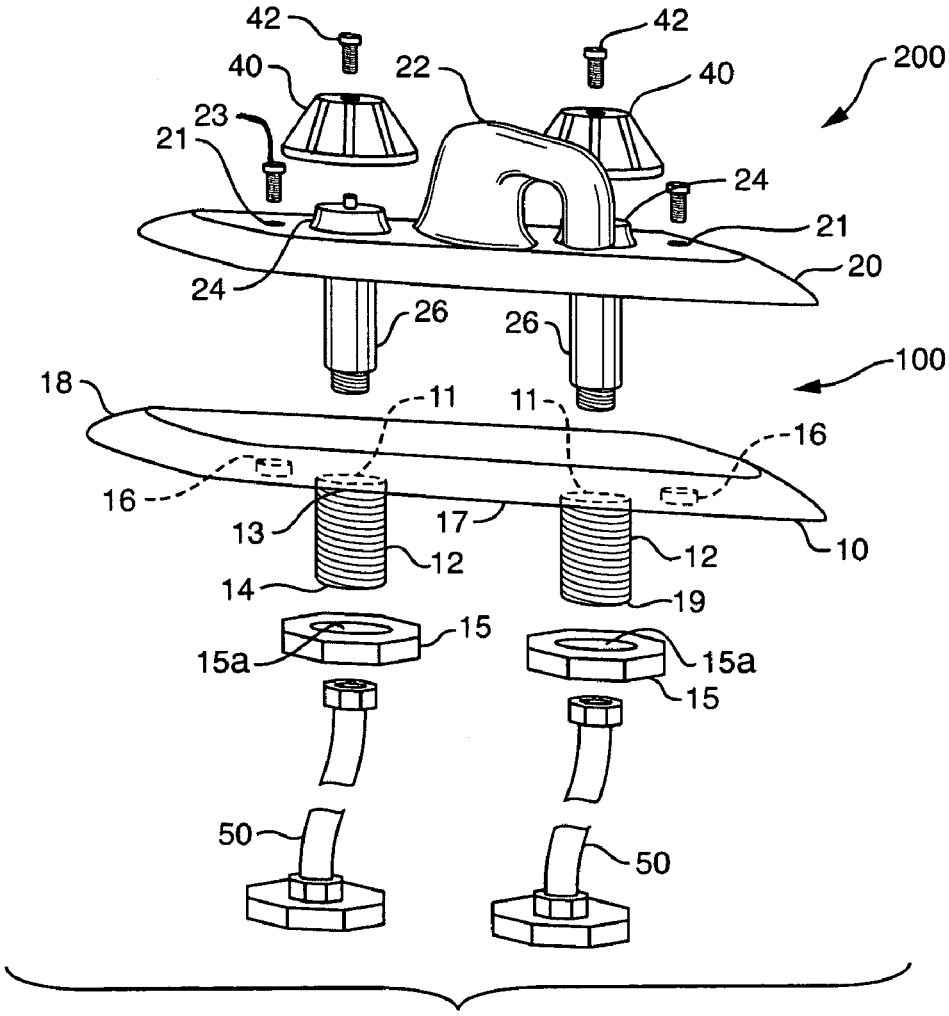
FIG. 1 is an exploded front perspective view of the inventive mounting device for a plumbing fixture.
Figure 2:
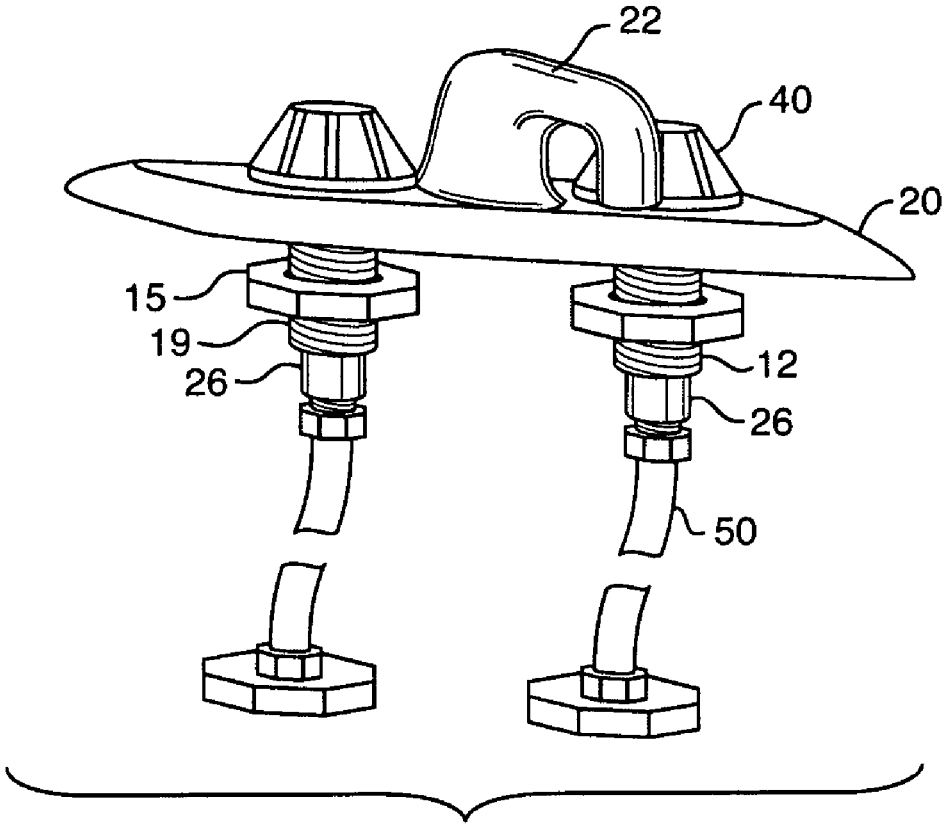
FIG. 2 is a front perspective view of the assembled inventive mounting device for a plumbing fixture.

Referring now to the drawings, in which like reference numerals are used to refer to the same or similar elements, FIG. 1 illustrates, in an exploded view, the mounting assembly 100 which removably mounts the faucet assembly 200 on the top side of a sink deck having at least one sink hole. The mounting assembly 100 is secured to the sink and includes a base 10 which sits on the top side of the sink deck. The base 10 has at least one bore 11.

Hollow members 12 connect to the base 10. The hollow members 12 are preferably cylinders; they extend from the bore 11 in the base 10 and pass through the sink hole. The hollow members have a top opening 13 and a bottom opening 14 which are preferably aligned. The top opening 13 preferably corresponds with the bore 11 of the base 10.

A locking device 15 secures the base 10 to the sink deck. The locking device 15 is a coupling having internal threads 15*a* but can also be other conventional fastening devices, i.e., nut, pin, clamp. The hollow members 12 have external threads 19 which extend along their length, preferably at the end of the hollow member 12 adjacent the base 10. The internal threads 15*a* of the coupling 15 engage the external threads 19 of the hollow members 12. The coupling 15 secures the mounting assembly 100 to the sink deck, preferably engaging the underside of the sink to achieve a tight connection thereto.

The base 10 and the hollow members 12 preferably form a unitary structure. The unitary structure is preferably molded from plastic to minimize manufacturing costs. Alternatively, the hollow members 12 can be welded or glued or fastened by some other conventional means to the base 10.

The base can also be an embossed unit that is formed as part of the sink assembly.

The faucet assembly 200 includes a housing 20 and a centrally disposed spout 22 extending outwardly from the housing 20. Control handles 40 are disposed on each side of the spout 22. Valve assemblies 24 for the hot water line and the cold water line are housed in the faucet housing 20, as is well known in the art. The valve assemblies 24 connect to the control handles 40 via screws 42. Internal conduits (not shown) connect the valve assemblies 24 to an internal water passage 41 (shown in FIG. 3) in the faucet housing 20. The internal water passage 41 transfers water from the conduits to the spout 22.

Water tubes 26 fluidly communicate with the valve assemblies 24, as is well known. The water tubes 26 connect to the valve assemblies 24 at one end and to water supply lines 50 at their other end. The water supply lines 50 connect to the water tubes 26 via conventional fastening devices, i.e., couplings, etc.

The faucet assembly 200 is connected to the mounting assembly 100 by fasteners 23. In the preferred embodiment, countersunk holes 21 are formed in the faucet housing 20 and aligned with threaded holes 16 formed in base 10 of the mounting assembly 100. Fasteners 23 pass through the countersunk holes 21 and engage the threaded holes 16 in the base 10. The fasteners 23 are not limited to screws and may comprise other well-known fastening devices.

The control handles 40 preferably cover the countersunk holes 21 in the faucet housing 20.

The hollow members 12 are adapted to receive the waterway tubes 26. The waterway tubes 26 pass through the bores 11 of the base 10 and through the hollow members 12 and connect to the water supply lines 50.

Figure 3:
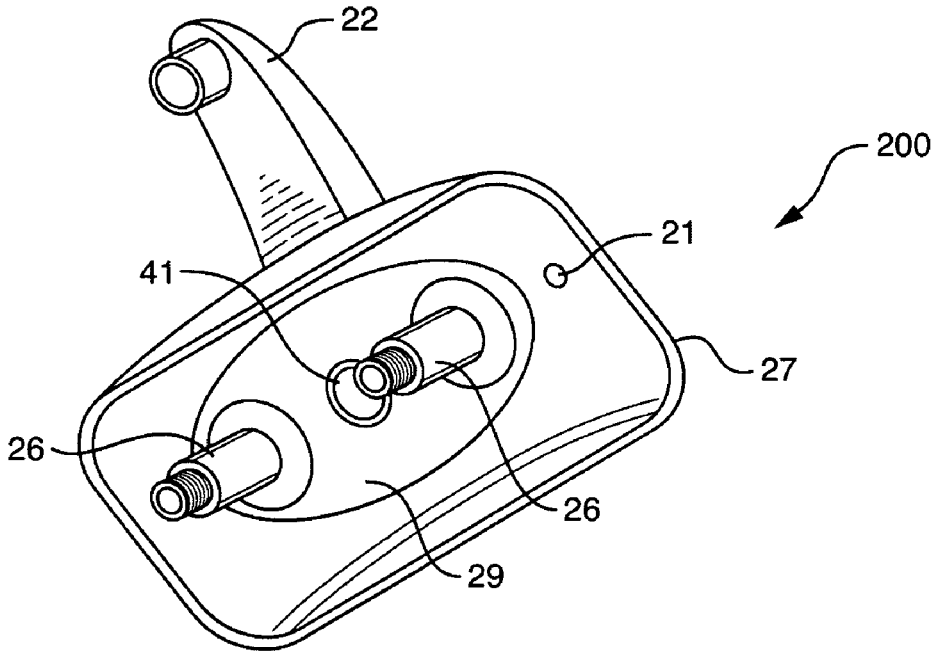
FIG. 3 is a bottom perspective view of the female part of the inventive mounting device for the plumbing fixture.

The faucet housing 20 includes a female member 27 (as shown in FIG. 3) having a cavity 29. The female member 27 preferably has a skirted shape. The female member 27 is preferably raised from the sink deck to receive the base 10 of the mounting assembly 10 in the cavity 29. The female member 27 sits flush over and preferably completely covers the base 10 when the faucet assembly 200 is secured to the mounting assembly 100.

The base 10 of the mounting assembly 100 forms a male member which adapts to any size and shape to correspondingly mate with the cavity 29 of the female member 27. The base 10 preferably includes a bottom wall 17 and a continuous oval skirt 18 that extends from the bottom wall 17. Although the Figures illustrate a continuous oval skirt 18, the base 10 can have side walls that do not extend around the entire periphery of the bottom wall 17.

The bores 11 are formed in the bottom wall 17 of the base 10.

The base 10 of the mounting assembly 100 and the cavity 29 of the female member 27 preferably have matching profiles which form a tight fit connection there between to minimize any movement or shaking of the faucet assembly 200 on the sink deck. The female member 27 of the faucet housing 20 and the base 10 of the mounting assembly are preferably molded parts and can be made contemporaneously to reduce manufacturing costs and to secure matching profiles of both parts.

The mounting assembly 100 remains engaged with the sink deck after removal of the faucet assembly 200. The mounting assembly 100 can be used with any other plumbing fixture having a cavity 29 which can receive the base 10 and countersunk holes 11 which are aligned with the threaded holes 16 in the base 10.

Figure 4:
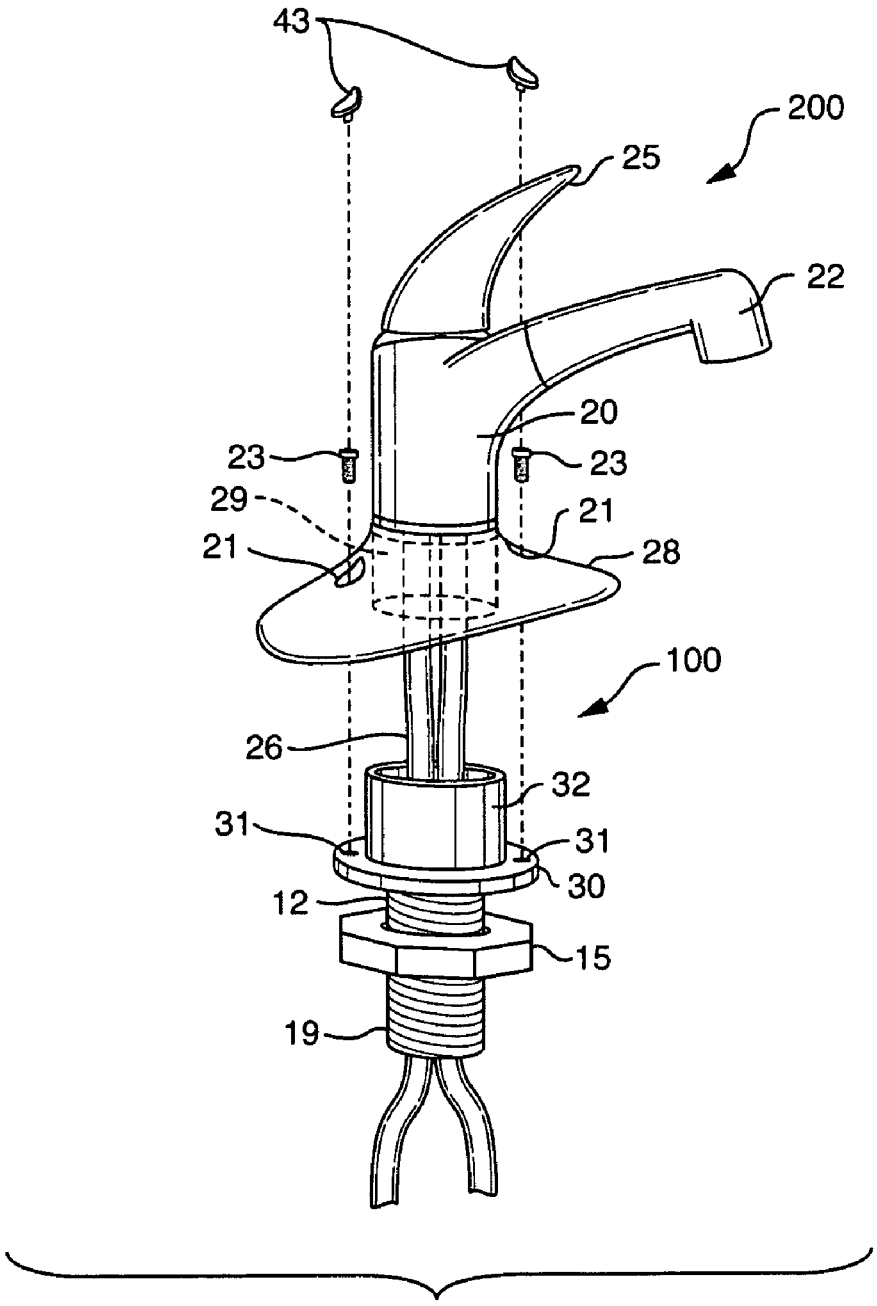
FIG. 4 is a side perspective view of the inventive mounting device for a single handle plumbing fixture.

FIG. 4 shows a second embodiment of the present invention where the mounting assembly 100 supports a conventional single handle faucet assembly 200 having a single control handle 25 on a sink deck. The hollow member 12 extends through the sink hole above the sink deck. The mounting assembly 100 comprises a radially extending flange 30 which sits on the sink deck. A hollow male member 32, preferably tubular, extends upward from the radial flange 30 and into the cavity 29 of the faucet housing 20. The radially extending flange 30 includes at least one threaded hole 31. The faucet housing 20 includes openings 21 aligned with the threaded hole 31. The openings are preferably located in base 28 of the faucet housing 20. Fasteners 23, preferably screws 23, are received in the openings 21 and engage the threaded hole 31 in the flange 30 whereby removably connecting the faucet assembly 200 to the mounting assembly 100. Caps 43 cover the openings 21 in the faucet housing 20 to provide an aesthetically pleasing appearance.

The hollow member 12 extends down from the flange 30 below the sink deck in alignment with the hollow male member 32. A coupling 15 with internal threads (not shown) engages external threads 19 of the hollow member 12 to secure the mounting assembly 100 to the sink deck.

The waterway tubes 26 extend down through the hollow male member 32 and the hollow member 14 of the mounting assembly and are connected to water supply lines (note shown) beneath the sink deck.

Figure 5:
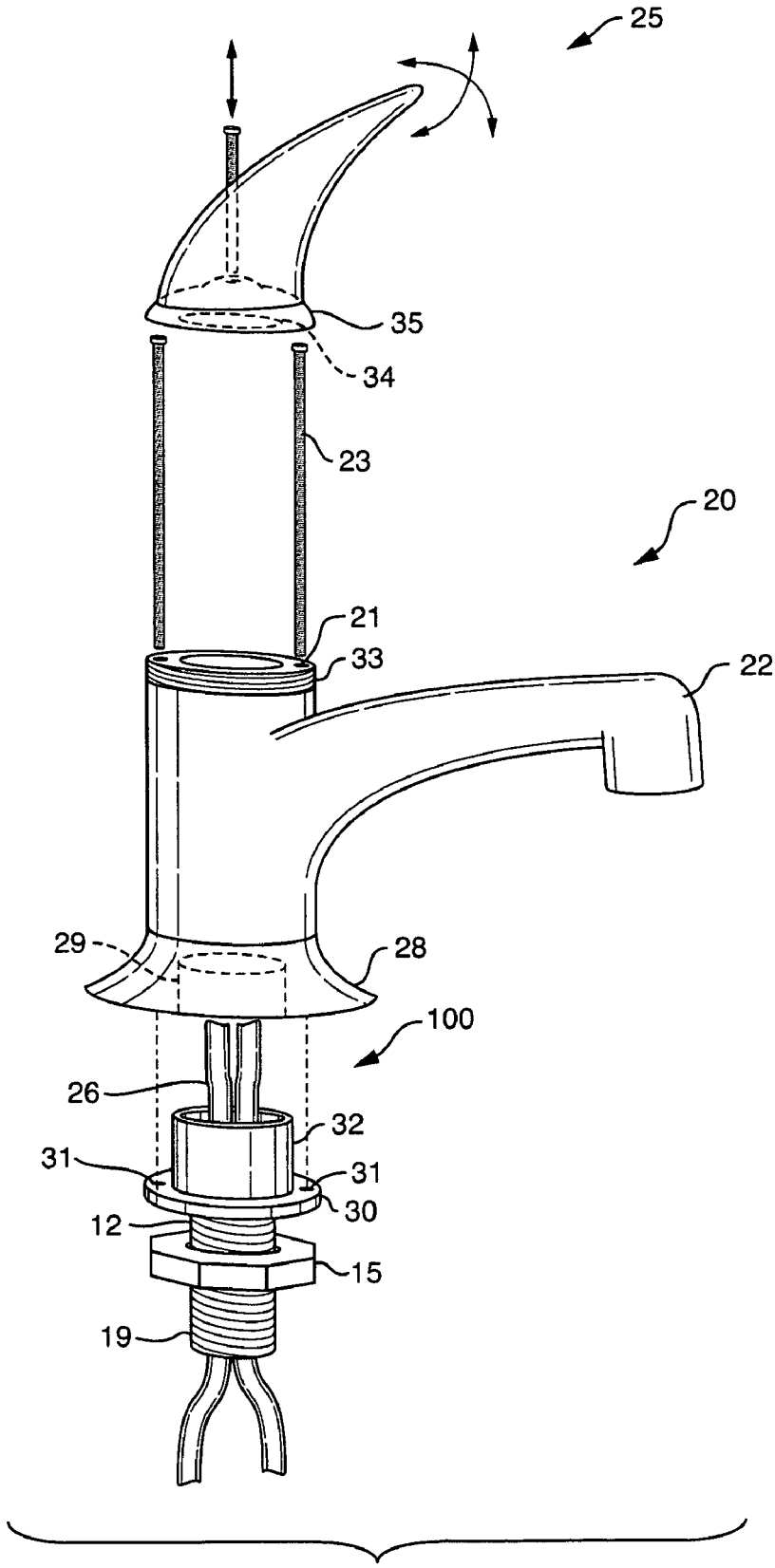
FIG. 5 is a front elevation view of the inventive mounting device for a single handle plumbing fixture with fasteners that travel through the main body of plumbing fixture.

In a third embodiment of the present invention, as illustrated in FIG. 5, the single handle faucet assembly 200 includes a removably connected handle 25 having a bottom receptacle part 34. The faucet housing 20 includes external threads 33 which engage internal threads formed 35 in the receptacle 34. The handle 25 is removable from the faucet housing 20 to expose openings 21. Fasteners 23, preferably screws, are received in the openings 21 and extend through length of faucet housing 20.

The mounting assembly 100 has threaded holes 31 that are aligned with the holes 21 of the faucet housing 20. Fasteners 23 are received in the holes 21 and engage the threaded mounting holes 31 of the mounting assembly 100 to removably attach the faucet 20 to the mounting assembly 100.

The hollow member 12 is adapted to receive water tubing 26 of the faucet housing 20 to allow the faucet housing to be fluidly connected to a water supply line (not shown).

In accordance with the principles of the subject invention, to remove the faucet housing 20 from the sink deck, the fasteners 23 are disengaged from mounting assembly 100, the faucet housing 20 is then lifted upward away from the sink deck until the water supply line passes through the sink hole above the sink deck. The water tubing 26 is then disconnected from the water supply line.

While a specific embodiment of the invention has been shown and described in detail to illustrate the application of the principles of the invention, it will be understood that the invention may be embodied otherwise without departing from such principles.

What is claimed is:

1. A plumbing fixture having a mounting assembly for removably mounting the plumbing fixture to a sink deck with a sink hole, the plumbing fixture having a housing, a water outlet, and a tubing assembly fluidly connected to the water outlet, the tubing assembly having a lower end for connecting to an upper end of a water supply line, the housing also having a cavity, the mounting assembly comprising:

a mounting member having a bore, the mounting member positioned between the housing and the sink deck, the mounting member adapted to be received in the cavity of the housing;

a means for removably attaching the housing to the mounting member;

at least one hollow member which is connected to the mounting member but which is not adapted to directly carry water from the water supply line, the hollow member extended from the bore in the mounting member and passes through the sink hole, the hollow member adapted to receive the tubing assembly therein and for receiving the upper end of the water supply line there-through so that the upper end of the water supply line can be connected to the lower end of the tubing assembly above the mounting member; and a means for securing the hollow member to the sink.

2. A plumbing fixture having a mounting assembly for removably mounting the plumbing fixture to a sink deck with a sink hole as claimed in claim 1, wherein the at least one hollow member has external threads and the means for securing the hollow member to the sink comprises a coupling having internal threads which engage the external threads, the coupling removably engages an underside of the sink.

3. A plumbing fixture having a mounting assembly for removably mounting the plumbing fixture to a sink deck with a sink hole as claimed in claim 1, wherein the means for removably attaching the housing to the mounting member comprises at least one threaded hole in the mounting member aligned with an opening in the housing and a fastener received in the opening and threadingly engaged in the at least one threaded hole.

4. A plumbing fixture having a mounting assembly for removably mounting the plumbing fixture to a sink deck with a sink hole as claimed in claim 3, further comprising a cap which is received in the opening.

5. A plumbing fixture having a mounting assembly for removably mounting the plumbing fixture to a sink deck with a sink hole as claimed in claim 3, wherein the plumbing fixture has at least one control handle that covers the opening in the housing to hide the fastener.

6. A plumbing fixture having a mounting assembly for removably mounting the plumbing fixture to a sink deck with a sink hole as claimed in claim 1, wherein the plumbing fixture further comprising a female structure which defines a profile of the cavity and the mounting member is received in the female structure.

7. A plumbing fixture having a mounting assembly for removably mounting the plumbing fixture to a sink deck with a sink hole as claimed in claim 6, wherein the female structure preferably has a skirted shape raised from the sink deck.

8. A plumbing fixture having a mounting assembly for removably mounting the plumbing fixture to a sink deck with a sink hole as claimed in claim 6, wherein the mounting member has a profile which matches the profile of the cavity so that there is a tight fitting connection between the housing and the mounting assembly.

9. A plumbing fixture having a mounting assembly for removably mounting the plumbing fixture to a sink deck with a sink hole as claimed in claim 1, wherein the mounting member and the at least one hollow member comprise a unitary part.

10. A plumbing fixture having a mounting assembly for removably mounting the plumbing fixture to a sink deck with a sink hole as claimed in claim 1, wherein the mounting member further comprises a radial flange and a hollow male member extended upward from the radial flange, the hollow male member is received in the cavity of the housing and is aligned with the hollow member.

11. A plumbing fixture having a mounting assembly for removably mounting the plumbing fixture to a sink deck with a sink hole as claimed in claim 1, wherein the plumbing fixture comprises a single handle faucet having a removable control handle.

12. A plumbing fixture having a mounting assembly for removably mounting the plumbing fixture to a sink deck with a sink hole as claimed in claim 11, further comprising at least one opening in the housing for receiving a fastener which engages the mounting assembly, wherein the removable control handle covers the opening.

13. A plumbing fixture having a mounting assembly for removably mounting the plumbing fixture to a sink deck with a sink hole as claimed in claim 1, wherein the mounting member is an enclosed unit that is formed as part of the sink deck.

14. An apparatus for removably mounting a plumbing fixture on a sink with at least one sink hole, the plumbing fixture having a housing, a water outlet, a cavity formed in the housing and a tubing assembly, the tubing assembly having a lower end for connecting to an upper end of a water supply line, the apparatus comprising:

a mounting member having a bore, the mounting member positioned between the housing and the sink, the mounting member adapted to be received in the cavity of the housing;

a means for removably attaching the housing to the mounting member;

at least one hollow member which is connected to the mounting member but which is not adapted to directly carry water from the water supply line, the hollow member extended from the bore in the mounting member and passes through the sink hole, the hollow member adapted to receive the tubing assembly therein and for receiving the upper end of the water supply line there-through so that the upper end of the water supply line can be connected to the lower end of the tubing assembly above the mounting member; and a means for securing the hollow member to the sink.

15. An apparatus for removably mounting a plumbing fixture on a sink with at least one sink hole, the plumbing fixture having a housing, a water outlet, a cavity formed in the housing and a tubing assembly, as claimed in claim 14, wherein the at least one hollow member has external threads and the means for securing the hollow member to the sink comprises a coupling having internal threads which engage the external threads, the coupling removably engages an underside of the sink.

16. An apparatus for removably mounting a plumbing fixture on a sink with at least one sink hole, the plumbing fixture having a housing, a water outlet, a cavity formed in the housing and a tubing assembly, as claimed in claim 14, wherein the means for removably attaching the housing to the mounting member comprises at least one threaded hole in the mounting member aligned with an opening in the housing and a fastener received in the opening and threadingly engaged in the at least one threaded hole.

17. An apparatus for removably mounting a plumbing fixture on a sink with at least one sink hole, the plumbing fixture having a housing, a water outlet, a cavity formed in the housing and a tubing assembly, as claimed in claim 14, wherein the mounting member has a profile which matches a profile of the cavity so that there is a tight fitting connection between the housing and the apparatus.

18. An apparatus for removably mounting a plumbing fixture on a sink with at least one sink hole, the plumbing fixture having a housing, a water outlet, a cavity formed in the housing and a tubing assembly, as claimed in claim 14, wherein the apparatus further comprises a radial flange and a hollow male member extended upward from the radial flange, the hollow male member is received in the cavity of the housing and is aligned with the hollow member.

19. An apparatus for removably mounting a plumbing fixture on a sink with at least one sink hole, the plumbing fixture having a housing, a water outlet, a cavity formed in the housing and a tubing assembly, as claimed in claim 14, wherein the mounting member is received in the cavity of the housing.

20. An apparatus for removably mounting a plumbing fixture on a sink with at least one sink hole, the plumbing fixture having a housing, a water outlet, a cavity formed in the housing and a tubing assembly, as claimed in claim 14, wherein the mounting member and at least one hollow member comprise a unitary part.

* * * * *